US005957820A

United States Patent [19]

Zarillo et al.

[11] Patent Number: 5,957,820

[45] Date of Patent: Sep. 28, 1999

[54] APPARATUS FOR STIMULATING HAMSTRING CONTRACTION TO EFFECT OPTIMUM ABDOMINAL MUSCLE CONDITIONING

[76] Inventors: William Zarillo, 350 Bristol St., D-12; John P. Diamond, Jr., 350 Bristol St., D-8, both of Waterbury, Conn. 06708; Keith L. Offenhauer, 2520 89th St., NW., Bradenton, Fla. 34209

[21] Appl. No.: 08/998,515

[22] Filed: Dec. 26, 1997

Related U.S. Application Data

[60] Provisional application No. 60/060,927, Oct. 3, 1997.

[51] Int. Cl.[6] ..... A63B 21/045

[52] U.S. Cl. ..... 482/121; 482/122; 482/127

[58] Field of Search ..... 482/140, 145, 482/127, 130, 121, 123, 122

[56] References Cited

U.S. PATENT DOCUMENTS

| | | |
|---|---|---|
| D. 339,618 | 9/1993 | Hassell . |
| 3,567,218 | 3/1971 | Johnson . |
| 4,508,335 | 4/1985 | Kelley et al. . |
| 4,509,748 | 4/1985 | Bezak . |
| 5,009,417 | 4/1991 | Sarkozi . |
| 5,106,083 | 4/1992 | Hall . |
| 5,403,258 | 4/1995 | Hill . |
| 5,545,114 | 8/1996 | Gvoich . |
| 5,669,862 | 9/1997 | Sayman ..... 482/140 |

*Primary Examiner*—Jerome W. Donnelly
*Attorney, Agent, or Firm*—Raymond A. Nuzzo

[57] ABSTRACT

A muscle strengthening apparatus comprising a feet securing member for securing the feet of a user, a support member for contacting the buttocks of the user, and a resilient member attached between the feet securing member and the support member. The resilient member comprises a first portion and a second portion wherein the first and second portions are angulated with respect to each other. The first and second portions each have an end opposite the point of contiguity of the first and second portions. The feet securing member is attached to the end of the first portion. The support member is attached to the end of the second portion. When the user's feet are secured by the feet securing member and the user's buttocks contacts the buttocks support member, the first and second portions of the resilient member are positioned generally posteriorly and/or medially with respect to the legs of the user.

3 Claims, 6 Drawing Sheets

APPARATUS FOR STIMULATING HAMSTRING CONTRACTION TO EFFECT OPTIMUM ABDOMINAL MUSCLE CONDITIONING

This application claims the benefit of the filing date of commonly owned and copending U.S. Provisional application Ser. No. 60/060,927 filed Oct. 3, 1997.

BACKGROUND OF THE INVENTION

Copyright Notice

© Copyright 1997, William Zarillo and John P. Diamond, Jr. All rights reserved. A portion of the disclosure of this patent document contains material that is subject to copyright protection. The copyright owner has no objection to the facsimile reproduction by anyone of the patent document or the patent disclosure, as it appears in the USPTO patent file or records, but otherwise reserves all copyright rights whatsoever.

Field of the Invention

The present invention relates to an apparatus for exercising and strengthening muscles of the human body.

Problem to be Solved

Adominal weakness is a common problem. Physicians and personal trainers have advocated the use of the "sit-up" and/or exercise as a means of strengthening abdominal muscles. However, these conventional methods of sit-ups or crunches are ineffective and inefficient because they involve more of the hip-flexors than the abdominals.

Conventional devices for exercising and strengthening abdominal muscles are inefficient because the effort expended by the users of such devices is predominately directed to exercising the hip flexor rather than strengthening the abdominal muscles. Furthermore, many conventional exercise devices overdevelop the hip flexors, particularly the iliopsoas, which can contribute to the pouching of the lower abdominal area.

It is therefore an object of the present invention to provide a muscle strengthening apparatus for exercising and strengthening abdominal muscles which solves the aforementioned problems related to traditional sit-up exercises and addresses the deficiencies of conventional devices.

It is another object of the present invention to provide a muscle strengthening apparatus for exercising and strengthening abdominal muscles and which also simultaneously exercises and strengthens other muscles.

It is a further object of the present invention to provide a muscle strengthening apparatus for exercising and strengthening abdominal and other muscles that is easy to use.

It is yet another object of the present invention to provide a muscle strengthening apparatus for exercising and strengthening abdominal muscles that is inexpensive to manufacture.

Still other objects and advantages of the present invention will in part be obvious and will in part be apparent from the specification.

SUMMARY OF THE INVENTION

The above and other objects, which will be apparent to those skilled in the art, are achieved in the present invention which is directed to, in a first aspect, a muscle strengthening apparatus comprising a feet securing member for securing the feet of a user, a support member for contacting the buttocks of the user, and a resilient member attached between the feet securing member and the buttocks support member. The resilient member comprises a first portion and a second portion wherein the first and second portions are angulated with respect to each other. The first and second portions each have an end opposite the point of contiguity of the first and second portions. The feet securing member is movably attached to the end of the first portion. The support member is attached to the end of the second portion. When the user's feet are secured by the feet securing member and the user's buttocks contacts the support member, the first and second portions of the resilient member are positioned generally posteriorly and/or medially with respect to the legs of the user.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

Definitions

In order to facilitate understanding of the purpose and effectiveness of the present invention as well as the ensuing description, the terms shown below have been defined accordingly:

a) As used herein, the terms "abdominal muscles", "abdominals" or "rectus abdominals" refer to the muscles that connect the lower ribs and xiphoid to the pubic bone. These muscles allow flexing of the spine (curling the trunk) and cause the pelvis to posteriorly tilt.

b) As used herein, the terms "obliques" and "transverse abdominus" refer to groups of muscles that are located on the side of the abdominals. The obliques and transverse abdominus cooperate to flex the spine and pull in or retract the stomach. Unilaterally, the obliques and transverse abdominus flex the spine laterally and obliquely.

c) As used herein, the term "psoas" or "iliopsoas", refers to muscles that are located anterior to the pelvis and inserted on the lumbar spine to the femur. The "psoas" are relatively stronger than the abdominals. The psoas muscles allow flexing of the spine and femur in a forward direction.

d) As used herein, the term "hamstring" or "hamstrings" refers to the muscles in the leg that extend the femur backwards and cause the pelvis to posteriorly tilt. When the hamstrings are contracted, they contribute to the inhibition of the psoas muscles and rectus femoris.

e) As used herein, the term "Gluteus Maximum", or "Gluts" refer to the muscles that are located posterior to the pelvis and inserted on the pelvis to the femur. When the Gluts contract, they can contribute to the inhibition of the psoas muscle.

f) As used herein, the term "rectus femoris" refers to muscles that are located anteriorly to the femor. These muscles flex the femor in the forward direction.

In describing the preferred embodiments of the present invention, reference will be made herein to FIGS. 1–14 of the drawings in which like numerals refer to like features of the invention.

Figure 2:
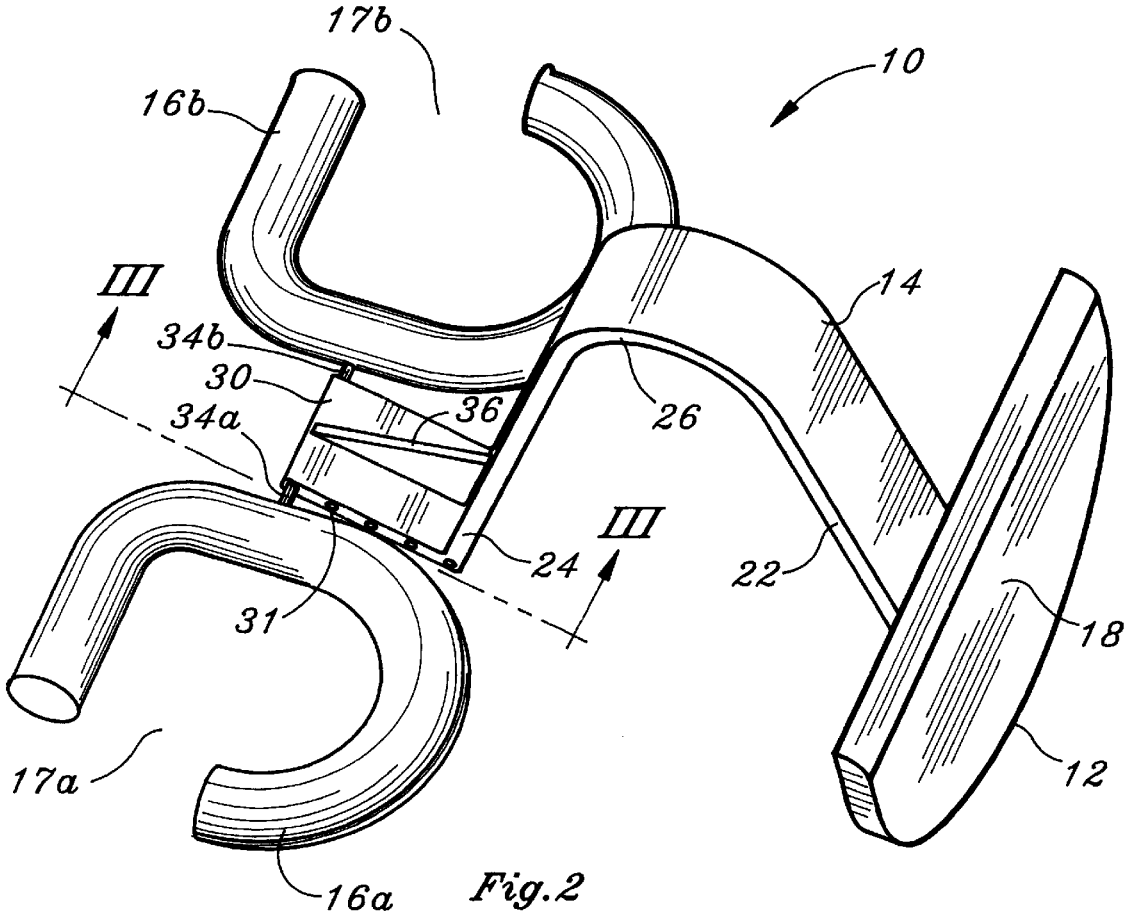
FIG. 2 is a perspective view of one embodiment of the muscle strengthening apparatus of the present invention.
Figure 5A:
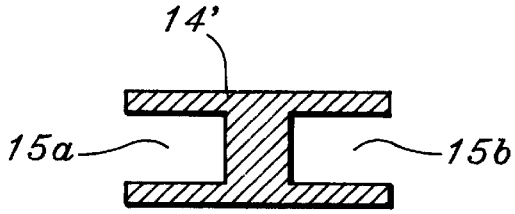
FIG. 5*a* is a cross-sectional view of an alternate embodiment of an intermediate member shown in FIGS. 1–5.
Figure 4:
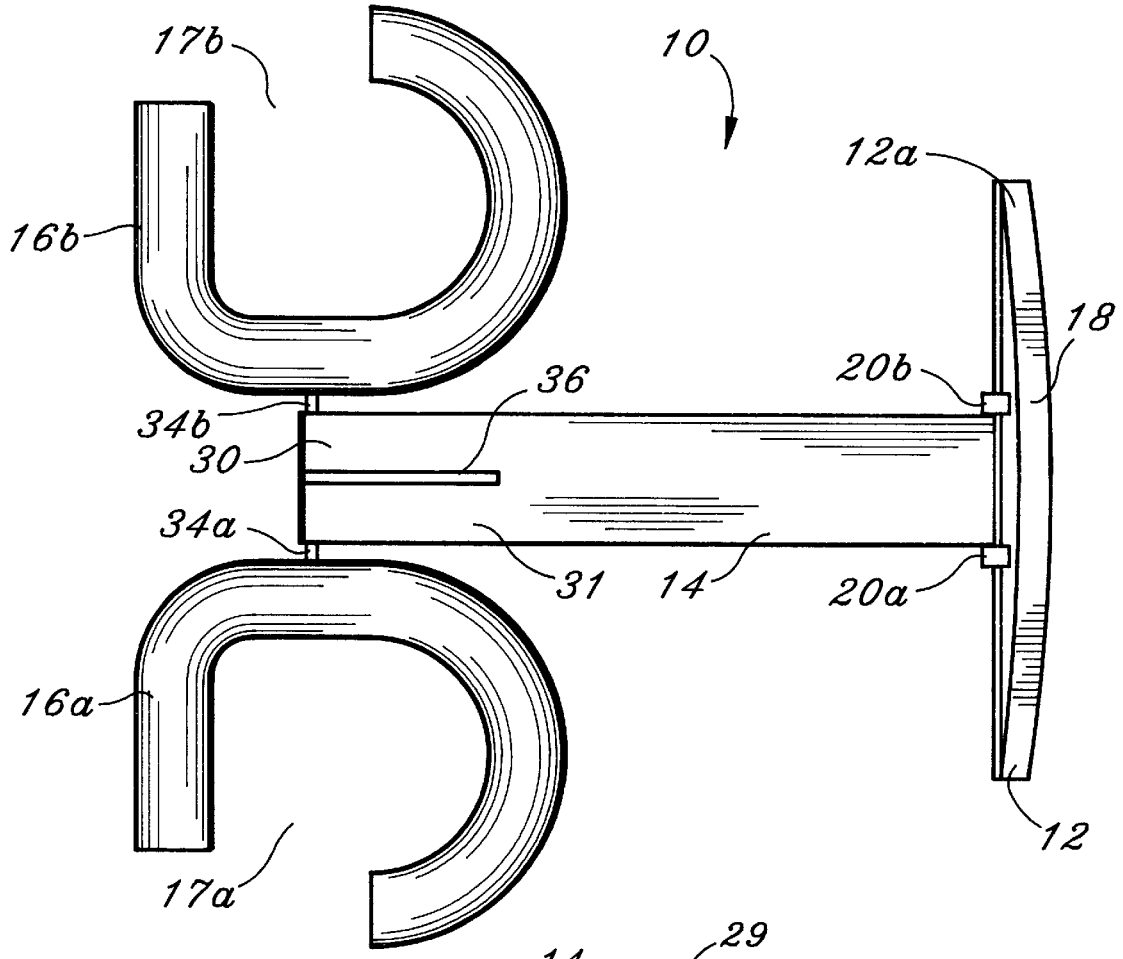
FIG. 4 is a top plan view of the muscle strengthening apparatus of FIG. 2.
Figure 5:
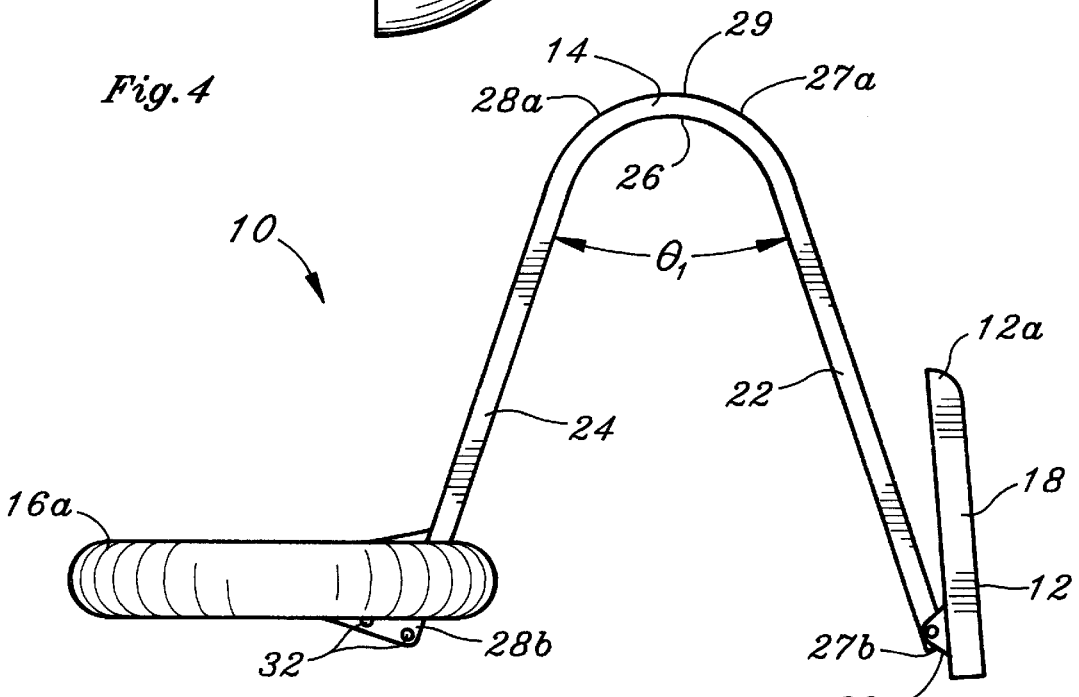
FIG. 5 is a side-elevational view of the apparatus of FIG. 2.

Referring to FIGS. 2, 4 and 5 show one embodiment of the muscle strengthening apparatus of the present invention. Apparatus 10 generally comprises buttocks support member 12, intermediate or central torsion member 14 and ankle supports 16*a* and 16*b*. Buttocks support member 12 contacts the buttocks and/or posterior thighs of the user. Support member 12 has top surface 18 that is configured with a predetermined contour that corresponds to the bone and muscular structure between the buttocks (gluteus maximus) and the upper hamstrings of the human anatomy. In a preferred embodiment, support member 12 has a substantially semi-circular shape, is substantially rigid and is fabricated from lightweight, durable materials such as plastic, rubber, fiberglass, graphite or other composite materials. Support member 12 may also have shapes other than the semi-circular. Support member 12 has mounts 20*a*, 20*b* for attachment to intermediate member 14. In a preferred embodiment, mounts 20*a*, 20*b* of support member 12 are rigidly attached to end portion 27*b*. In an alternate embodiment, mounts 20*a* and 20*b* are pivotally mounted to end 27*b*.

In a further embodiment, support member 12 has a pocket or cavity formed therein. The opening of the pocket or cavity is formed in top edge 12*a* of support member 12. End 27*b* of member 14 is slidably and removably disposed within the pocket or cavity.

Referring to FIG. 5, intermediate member 14 comprises portions or sides 22 and 24. Sides 22 and 24 are attached to one another. The point of attachment or contiguity is designated generally by numeral 26. In a preferred embodiment, sides 22 and 24 are angulated with respect to each other by angle $\theta_1$ (see FIG. 5). In a preferred embodiment, $\theta_1$ is between about 70° and 100°, inclusive. In a more preferred embodiment, $\theta_1$ is between 80° and 90°. In a most preferred embodiment, $\theta_1$ is about 90°. The lengths of sides 22 and 24 are substantially equal. Side 22 has end portions 27*a* and 27*b*. Side 24 has end portion 28*a* and 28*b*. In a preferred embodiment, end portions 27*a* and 28*a* are preferably curved in order to form curved or rounded portion 29. The purpose of curved portion 29 will be discussed below.

Referring to FIG. 2, in a preferred embodiment, intermediate member 14 is resilient. The thickness of member 14 depends upon the required degree of resistance or resiliency. In a preferred embodiment, member 14 has a substantially square or rectangular cross-sectional shape in order to reduce torsional twisting of member 14. However, member 14 may also have other cross-sectional shapes. Member 14 is preferably made from durable, flexible materials such as plastic, flexiglass or fiberglass. However, other materials having the required durability and flexibility may also be used.

FIG. 5*a* shows an alternate embodiment of intermediate member 14. Alternate intermediate member 14' has a substantially I-shaped cross-section. Elongate members having varying degrees of resistance may be disposed within channels 15*a*, 15*b* to increase the overall resistance of member 14'.

Figure 3:
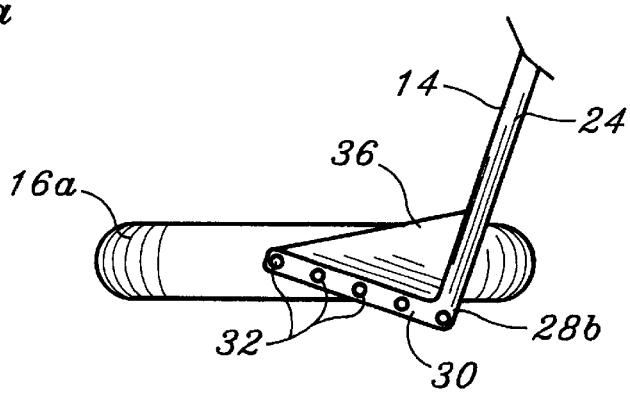
FIG. 3 is a view taken along line 3—3 of FIG. 2.

Referring to FIGS. 2, 3 and 4, support member 30 is attached to end 28 of side 24. Support member 30 has top surface 31 and a plurality of laterally oriented bores 32 formed therein. Each bore 32 is sized to slidably receive pins or axles 34*a*, 34*b* that are attached to ankle supports 16*a* and 16*b*, respectively. The plurality of bores 32 allow the position of ankle supports 16*a*, 16*b* to be varied according to the height of the user. In a preferred embodiment, the number of bores 32 is sufficient to allow ankle supports 16*a*, 16*b* to be varied between about 3 inches and 6 inches, inclusive. However, other distances may be achieved by increasing the number of bores 32 and the size of support member 30. Gusset or support bracket 36 is attached to top surface 31 of support member 30 and to side 24 of intermediate member 14. Gusset 36 provides structural support for the connection between side 24 and support member 30. In a preferred embodiment, support member 30 and gusset 36 are made of the same materials as intermediate member 14.

Referring to FIGS. 2, 3 and 4, ankle supports 16*a*, 16*b* each have a body portion that defines openings 17*a*, 17*b*, respectively, for receiving the feet and ankles of a user. Ankle supports 16*a* and 16*b* stabilize the feet and ankles to facilitate proper use of apparatus 10 of the present invention. This will be discussed in detail below. Pins or axles 34*a*, 34*b*, which are attached to ankle supports 16*a*, 16*b*, respectively, are slidably and rotatably disposed within bores 32. There is a minimal degree of friction between pins 34*a*, 34*b* and the inner walls (not shown) of the bores 32 in order to prevent pins 34*a*, 34*b* from becoming dislodged from bores 32 while allowing easy removal of pins 34*a*, 34*b* from the bores 32 and rotation of ankle supports 16*a*, 16*b*. Ankle supports 16*a*, 16*b* are able to freely rotate or pivot to provide "self adjustment" as the user uses apparatus 10 and to facilitate storage of apparatus 10 when not in use. In a preferred embodiment, ankle supports 16*a*, 16*b* are able to rotate 360°. The overall structure of each ankle support 16*a*, 16*b* is ergonomic so as to provide comfortable physical contact between the user's ankles and ankle supports 16*a*, 16*b*. The rotational feature and ergonomic design of ankle supports 16*a*, 16*b* substantially eliminate stress and/or strain on the user's ankles. In a preferred embodiment, ankle supports 16*a*, 16*b* have a substantially circular cross-section. Ankle supports 16*a*, 16*b* may take on any one of a variety of geometric shapes, e.g. substantially C-shaped, substantially J-shaped, etc. In a preferred embodiment, ankle supports 16*a,* 16*b* are fabricated from durable, lightweight materials such as metal, plastic, rubber, fiberglass, graphite or other composite materials. In a preferred embodiment, pins or axles 34*a,* 34*b* are fabricated from durable materials that can withstand stress. Preferably, pins or axles 34*a,* 34*b* are fabricated from metal, fiberglass, graphite or other composite materials. As described above, the position of ankle supports 16*a,* 16*b* on support member 30 can be adjusted by inserting pins 34*a,* 34*b* into any of bores 32 formed in support member 30 in order to accommodate users of different height.

Figure 6:
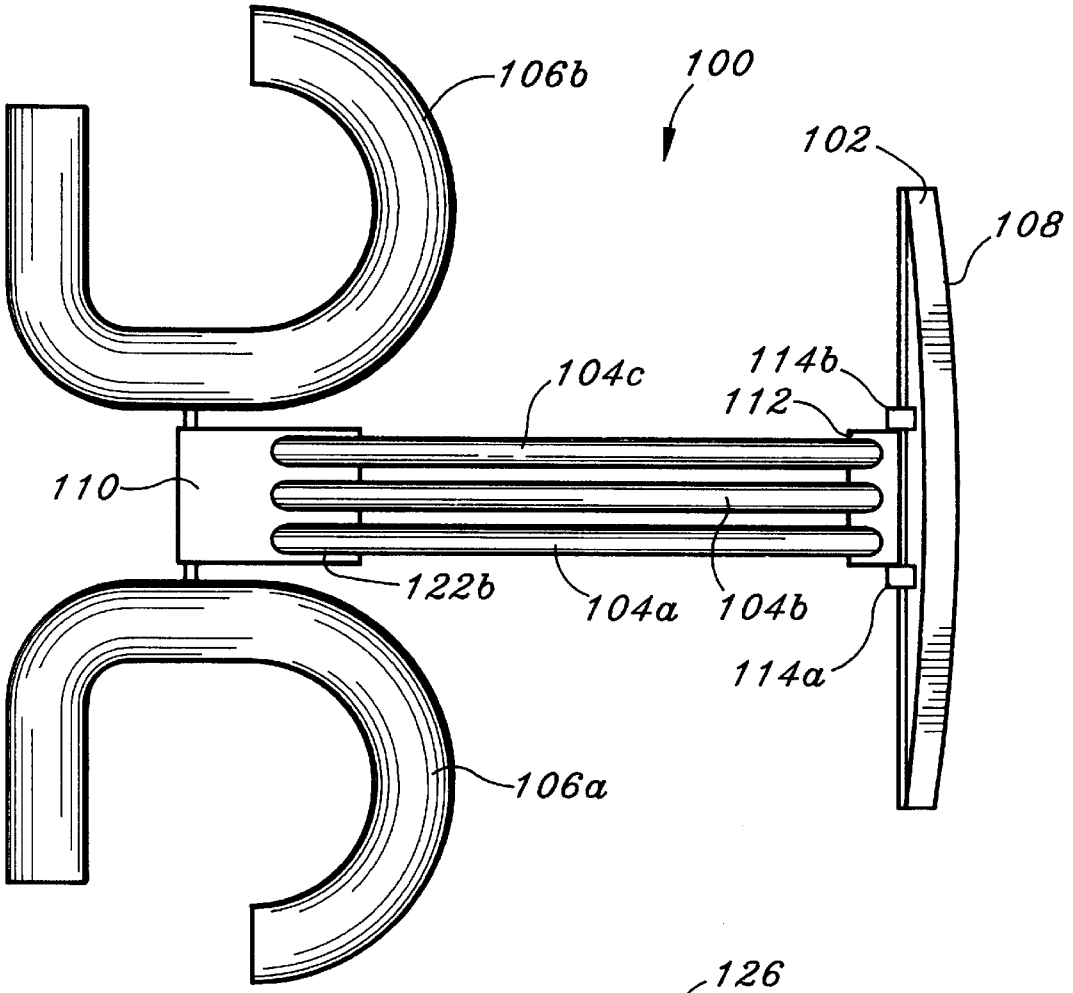
FIG. 6 is a top view of an alternate embodiment of the muscle strengthening apparatus of the present invention.
Figure 7:
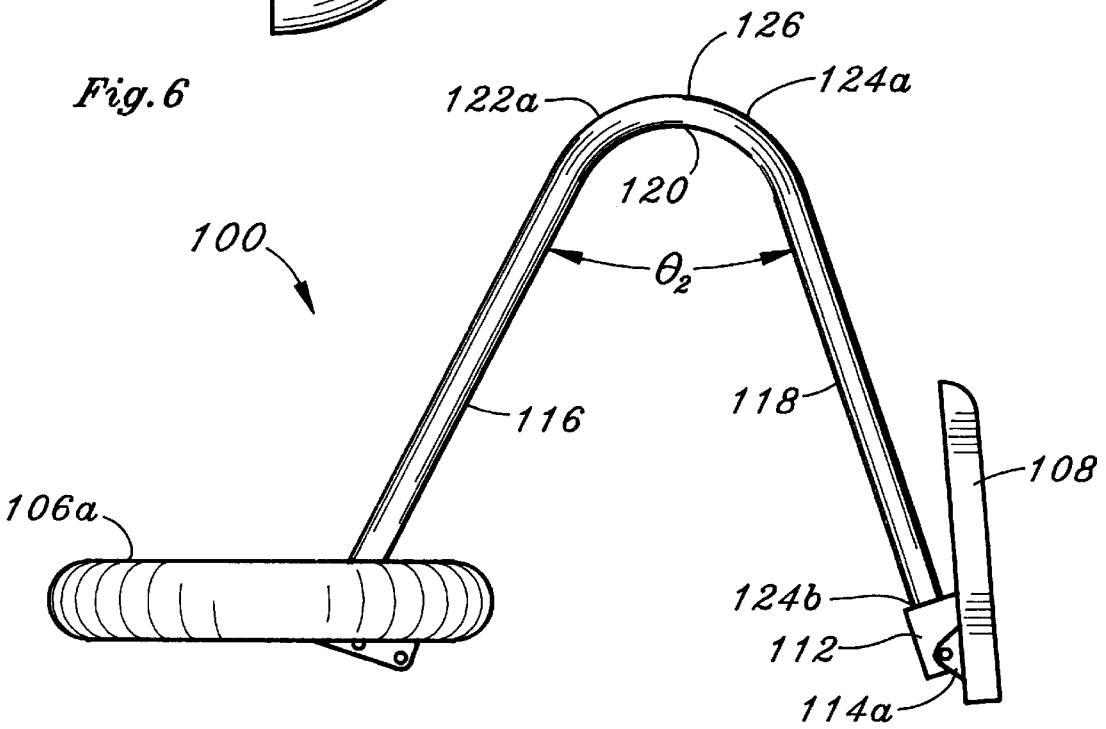
FIG. 7 is a side elevational view of the apparatus of FIG. 6.

Referring to FIGS. 6 and 7, an alternate embodiment 100 of the present invention is shown. Alternate embodiment 100 of the present invention generally comprises buttocks support member 102, intermediate members 104*a,* 104*b* and 104*c* and ankle supports 106*a* and 106*b.* Buttocks support member 102 contacts the buttocks and/or posterior thighs of the user. Apparatus 100 further includes support members 110 and 112. Support member 102 has top surface 108. Surface 108 is configured with a predetermined contour that corresponds to the bone and muscular structure between the buttocks (gluteus maximus) and the upper hamstrings of the human anatomy. In a preferred embodiment, support member 102 has a substantially semi-circular shape, is substantially rigid and is fabricated from lightweight, durable materials such as plastic, rubber, fiberglass, graphite, metal or other composite materials. Support member 102 may have a shape other than semi-circular. Support member 102 has mounts 114*a,* 114*b* for attachment to support member 112. In a preferred embodiment, mounts 114*a,* 114*b* of support member 102 are rigidly attached support member 112. In an alternate embodiment, mounts 114*a* and 114*b* are pivotally attached to support member 112. Other purposes and features of support member 102 will be discussed below.

In order to simplify the ensuing discussion, only intermediate member 104*a* is discussed. However, it is to be understood that the ensuing discussion is also applicable to intermediate members 104*b* and 104*c.* Referring again to FIGS. 6 and 7, intermediate member 104*a* comprises sides or portions 116 and 118. Sides 116 and 118 are connected to one another at a point of attachment or contiguity generally by numeral 120. In a preferred embodiment, sides 116 and 118 are angulated with respect to each other by angle $\theta_2$ (see FIG. 7). In a preferred embodiment, $\theta_2$ is between about 70° and 100°, inclusive. In a more preferred embodiment, $\theta_2$ is between 80° and 90°. In a most preferred embodiment, $\theta_2$ is about 90°. The lengths of sides 116 and 118 are substantially equal. Side 116 has end portions 122*a* and 122*b.* Side 118 has end portions 124*a* and 124*b.* In a preferred embodiment, end portions 122*a* and 122*a* are preferably curved in order to form curved or rounded portion 126. The purpose of curved portion 126 will be evident from the discussion below. In a preferred embodiment, intermediate member 104*a* is resilient. The thickness of member 104*a* depends upon the required degree of resistance or resiliency. Member 104*a* is preferably made from durable, flexible materials such as plastic, flexiglass or fiberglass. However, other materials having the required durability and flexibility may also be used.

Referring to FIG. 6, each member 104*a,* 104*b* and 104*c* has a specific cross-section to effect a specific flex mode. In a preferred embodiment, member 104*b* has a substantially square or rectangular cross-sectional shape in order to reduce torsional twisting of member 104*b.* However, member 104*b* may also have other cross-sectional shapes. In a preferred embodiment, members 104*a* and 104*c* each have a slightly oval cross-section. However, members 104*a* and 104*c* may also have other cross-sectional shapes, e.g. substantially circular cross-section, etc.

Figure 8A:
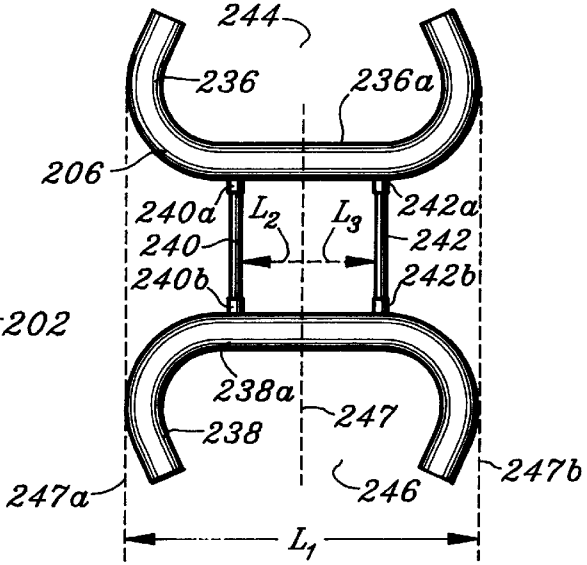
FIG. 8*a* is a top plan view of a feet securing member shown in FIG. 8.
Figure 10:
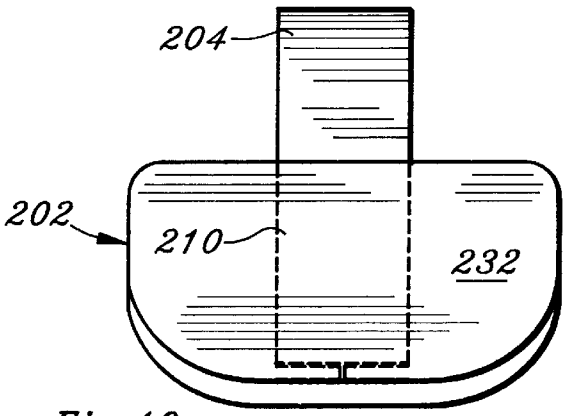
FIG. 10 is a partial, perspective view illustrating the attachment of a support member and intermediate member, both of which being shown in FIG. 8.
Figure 8:
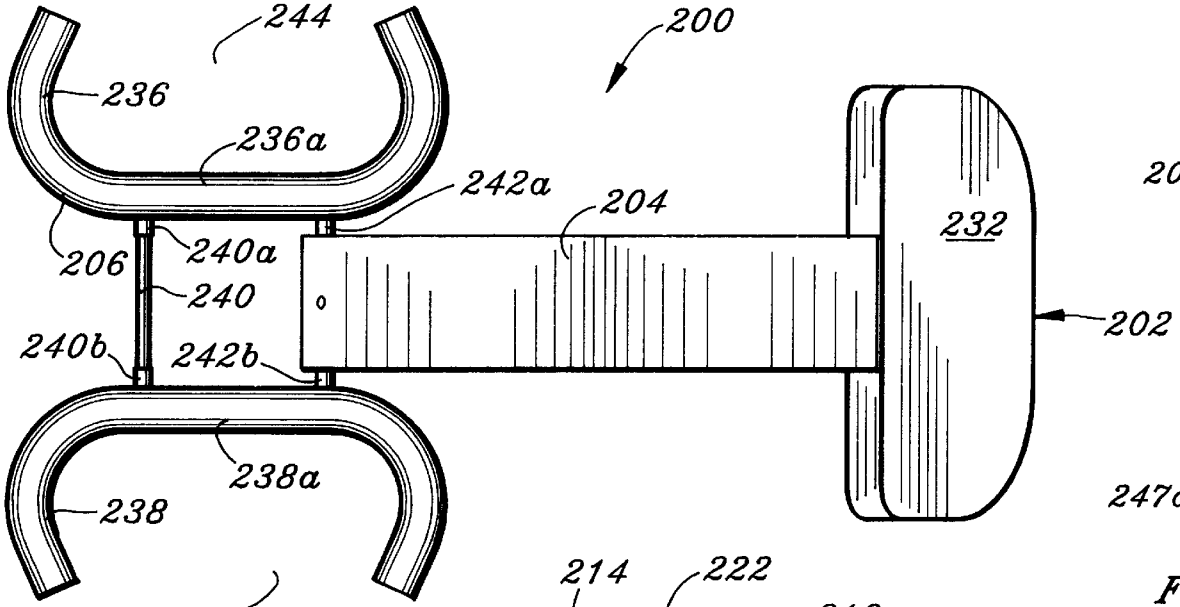
FIG. 8 is a top plan view of a further embodiment of the apparatus of the present invention.
Figure 9:
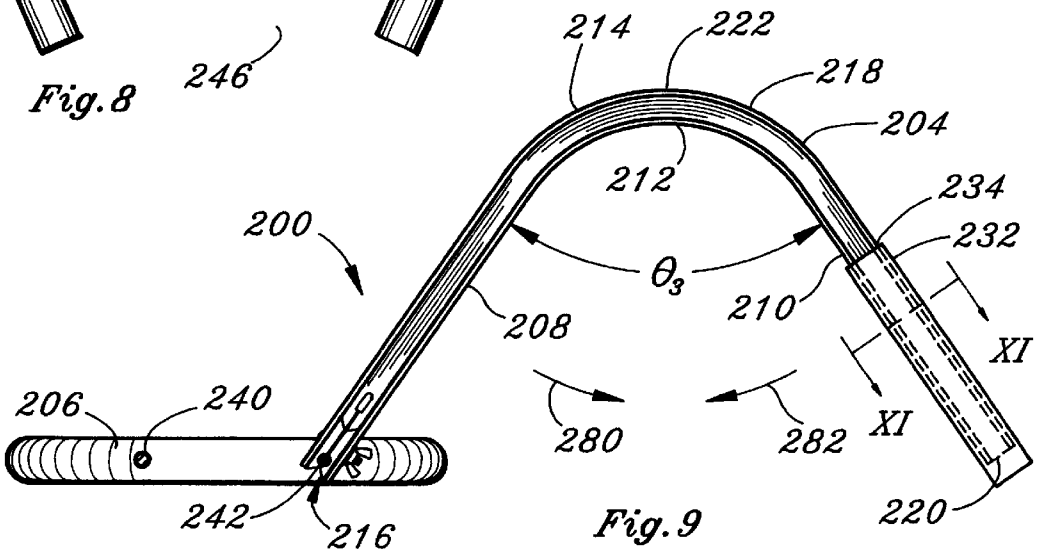
FIG. 9 is a side elevational view of the embodiment of FIG. 8.

Referring to FIGS. 8 and 9, an alternate embodiment 200 of the apparatus of the present invention is shown. Muscle strengthening apparatus 200 of the present invention generally comprises buttocks support member 202, intermediate or central torsion member 204 and feet securing member 206 that is movably attached to intermediate member 204. Buttocks support member 202 contacts the buttocks and/or posterior thighs of the user.

Referring to FIG. 9, intermediate member 204 comprises sides or portions 208 and 210. Sides 208 and 210 are attached to one another at a point of contiguity or attachment indicated generally by numeral 212. In a preferred embodiment, sides 208 and 210 are angulated with respect to each other by angle $\theta_3$. In a preferred embodiment, $\theta_3$ is between about 60° and 110°, inclusive. In a more preferred embodiment, $\theta_3$ is between 80° and 90°. In a most preferred embodiment, $\theta_3$ is about 90°. The lengths of sides 208 and 210 are substantially equal. Side 208 has end portions 214 and 216. Side 210 has end portion 218 and 220. In a preferred embodiment, end portions 214 and 218 are preferably curved in order to form curved or rounded portion 222. The purpose of curved portion 222 will be discussed below.

Figure 11:
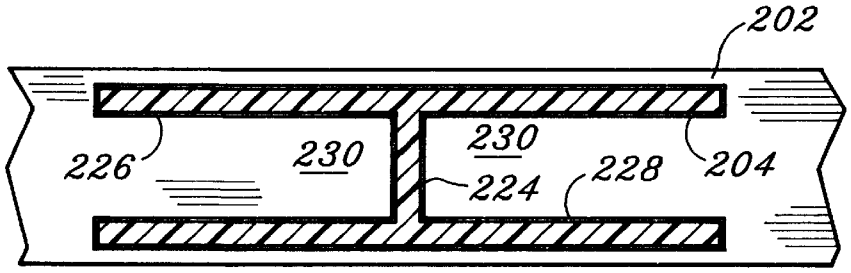
FIG. 11 is an end view taken along line XI—XI of FIG. 10.

Referring to FIGS. 9 and 11, intermediate member 204 is preferably resilient. The thickness of member 204 depends upon the required degree of resistance or resiliency. In a preferred embodiment, member 204 has a substantially "I" cross-sectional shape as shown in FIG. 11. Intermediate member 204 comprises central wall 224 that is intermediate and attached to portions 226 and 228. In a preferred embodiment, central wall 224 is substantially perpendicular to sections 226 and 228. Stiffening members (not shown) of varying degrees of resiliency may be inserted into spaces 230 of intermediate member 204 (see FIG. 11) to vary the overall resiliency of intermediate member 204. The substantially "I" cross-sectional shape of intermediate member 204 reduces torsional twisting of intermediate member 204 during use of apparatus 200 and provides strength and durability. Intermediate member 204 is preferably made from durable, flexible materials such as plastic, flexiglas or fiberglass. However, other materials having the required durability and flexibility may also be used.

Referring to FIGS. 8, 9, 10 and 12, support member 202 has top surface 232 for contacting the buttocks of the user. In one embodiment, top surface 232 is substantially planar. In another embodiment, top surface 232 is configured with a predetermined contour that corresponds to the bone and muscular structure between the buttocks (gluteus maximus) and the upper hamstrings of the human anatomy. In a preferred embodiment, support member 202 is substantially rigid and is fabricated from lightweight, durable materials such as metal, plastic, rubber, fiberglass, graphite or other composite materials. Support member 202 may be configured to have almost any type shape, e.g. round, semi-circular, etc. Support member 202 has bore or cavity 234 formed therein. Portion 210*a* of side 210 of intermediate member 204 is slidably, frictionally and removably disposed within bore 234.

Referring to FIGS. 8, 9 and 12–14, feet support member 206 comprises members 236 and 238 that are interconnected by axle or pin members 240 and 242. Member 236 has a body portion 236*a* that defines opening 244 for receiving the right foot and ankle of a user. Similarly, member 238 has body portion 238*a* that defines opening 246 for receiving the left foot and ankle of a user. Preferably, members 236 and 238 have a substantially circular cross-section. In a preferred embodiment, members 236 and 238 each have a substantially "C" shape. However, it is to be understood that members 236 and 238 may take on any one of a variety of geometric shapes, e.g. substantially J-shaped, etc. Members 236 and 238 stabilize the feet and ankles to facilitate proper use of apparatus 200 of the present invention. In a preferred embodiment, the overall structure of each member 236 and 238 is ergonomic so as to provide comfortable physical contact between the user's ankles and members 236 and 238. In a preferred embodiment, members 236 and 238 are fabricated from durable, lightweight materials such as metal, plastic, rubber, fiberglass, graphite or other composite materials. In a preferred embodiment, the portions of members 236 and 238 that contact the use's feet and ankles are comprised of soft, flexible material such as foam, rubber, cloth, etc. to provide comfortable contact with the user's feet and ankles. In a preferred embodiment, pins or axles 240 and 242 are fabricated from durable materials that can withstand stress. Preferably, pins or axles 240 and 242 are fabricated from metal, fiberglass, graphite or other composite materials.

Referring to FIG. 8, cowlings 240*a* and 240*b* are attached to members 236 and 238, respectively. Axle member 240 is attached to cowlings 240*a* and 240*b*. The outer diameter of cowlings 240*a* and 240*b* is greater than the outer diameter of axle member 240. Similarly, cowlings 242*a* and 242*b* are attached to members 236 and 238, respectively. Axle member 242 is attached to cowlings 242*a* and 242*b*. The outer diameter of cowlings 242*a* and 242*b* is greater than the outer diameter of axle member 242. The larger diameters of cowlings 240*a*, 240*b*, 242*a* and 242*b* prevent lateral movement of intermediate member 204 with respect to feet securing member 206.

Figure 12:
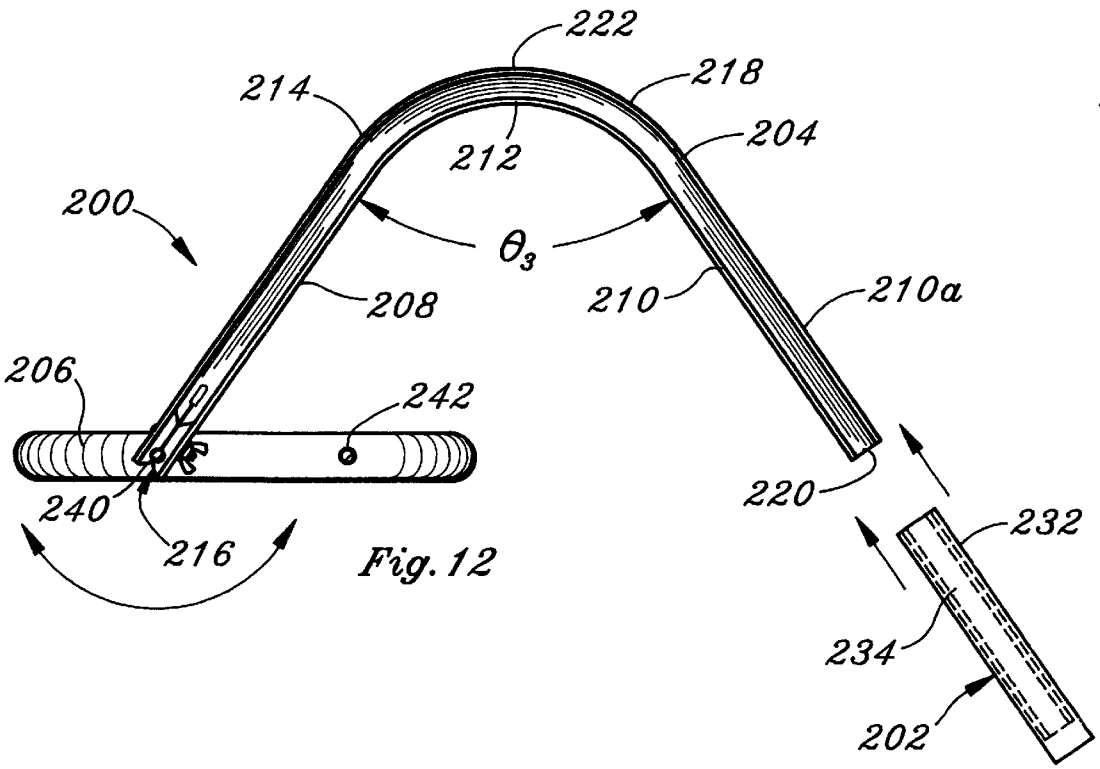
FIG. 12 is a side elevational view of the embodiment of FIG. 8 illustrating the movable feature of a feet securing member and the attachment of the support member to the intermediate member.

As shown in FIG. 8*a*, dotted line 247 bisects feet securing member 206. The overall length $L_1$ of feet securing member 206 is measured between dotted reference lines 247*a* and 247*b*. Dotted reference lines 247*a* and 247*b* are equidistant from bisecting line 247. Axle member 240 is positioned a distance $L_2$ from reference line 247. Axle member 242 is positioned a distance $L_3$ from line 247. In a preferred embodiment, length $L_2$ does not equal $L_3$. In one embodiment, length $L_2$ is greater than length $L_3$. In another embodiment, length $L_2$ is less than length $L_3$. Intermediate member 204 can be attached to either axle member 240 or 242 thereby providing two positions to which feet securing member 206 can be set. Additionally, when either axle member 240 or 242 is attached to intermediate member 204, feet securing member 206 may be rotated, as shown in FIG. 12, in order to provide two additional different positions to which feet securing member 206 can be set. Thus, axle members 240 and 242 and the difference in lengths $L_2$ and $L_3$ provide four (4) different positions to which feet securing member 206 can be set. Such a configuration allows users of varying heights to comfortably and efficiently use apparatus 200. Although two axle members or pins are shown in FIGS. 8 and 12, it is to be understood that in other embodiments, more than or less than two axle members or pins can be used.

Figure 13:
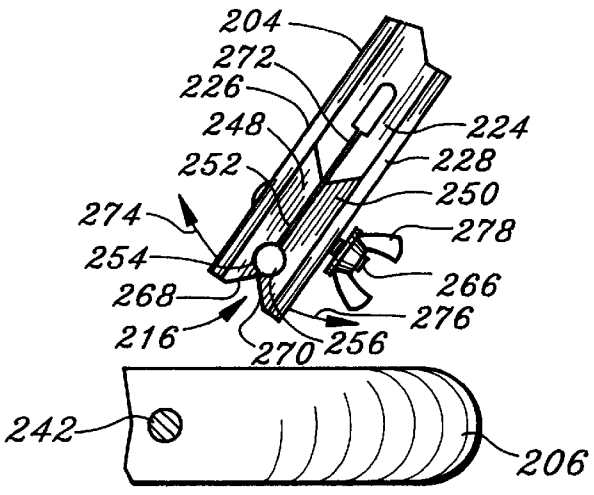
FIGS. 13 and 14 illustrate the interconnection between the feet securing member and the intermediate member, both of which being shown in FIG. 8.
Figure 14:
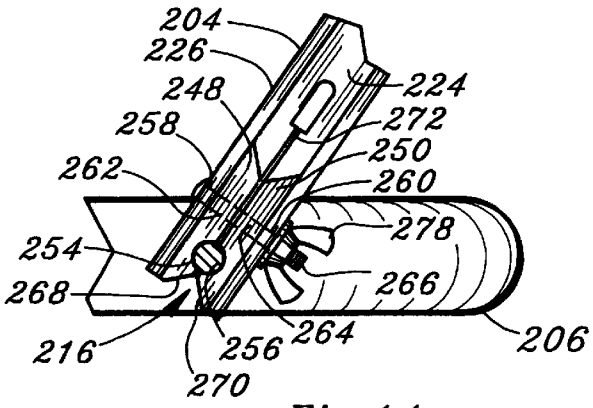

Referring to FIGS. 13 and 14, intermediate member 204 includes portions 248 and 250 adjacent end 216 of intermediate member 204. Portions 248 and 250 are attached to portions 226 and 228, respectively, of intermediate member 204. Portions 248 and 250 are separated by axially extending gap or slot 252. Portions 248 and 250 have cavities or indentations 254 and 256, respectively, for receiving either axle member 240 or axle member 242 (see FIGS. 8*a* and 12). Cavities or indentations 254 and 256 are substantially transverse to and extend through gap or slot 252. Portions 226 and 228 of intermediate member 204 have openings 258 and 260, respectively. Portions 248 and 250 have openings 262 and 264, respectively. Openings 258, 260, 262, and 264 are substantially coaxially aligned and are sized to receive fastener or screw 266.

Referring again to FIGS. 13 and 14, portion 248 has beveled or chamfered end 268 adjacent cavity 254. Similarly, portion 250 has beveled or chamfered end 270 adjacent cavity 256. When the user desires to insert axle members 240 or 242 into cavities 254 and 256, the user will press the axle member against ends 268 and 270. Gap 252 and slit 272, formed in central wall 224, cooperate to allow portions 248 and 250 to be spread or pushed apart in the direction of arrows 274 and 276 when the user presses the axle member against ends 268 and 270. Thus, gap or slot 252, chamfered ends 268 and 270, and slit 272 facilitate insertion of axle member 240 or axle member 242 into cavities 254 and 256. Once the axle member is positioned within cavities 254 and 256, screw 266 is inserted into openings 258, 260, 262 and 264 and is threadedly engaged with nut 278 to create a compressive force upon portions 248 and 250. Such action will force portions 248 and 250 to approach each other thereby locking the axle member in place to prevent its dislodgment from cavities 254 and 256. Screw 266 and nut 278 are preferably configured such that when nut 278 is completely fastened to screw 266, the axle member is able to freely pivot or rotate thereby allowing feet securing member 206 to freely rotate or pivot to provide "self adjustment" as the user uses apparatus 200 and to facilitate storage of apparatus 200 when not in use. The rotational or pivoting feature and ergonomic design of member 206 substantially eliminate stress and/or strain on the user's ankles.

The ensuing discussion pertains to using the apparatus of the present invention. To simplify the ensuing discussion, the use of the apparatus of the present invention is described in terms of apparatus 200. However, it is to be understood that the ensuing discussion is also applicable to alternate embodiments 10 and 100 (see FIGS. 1–7).

Figure 1:
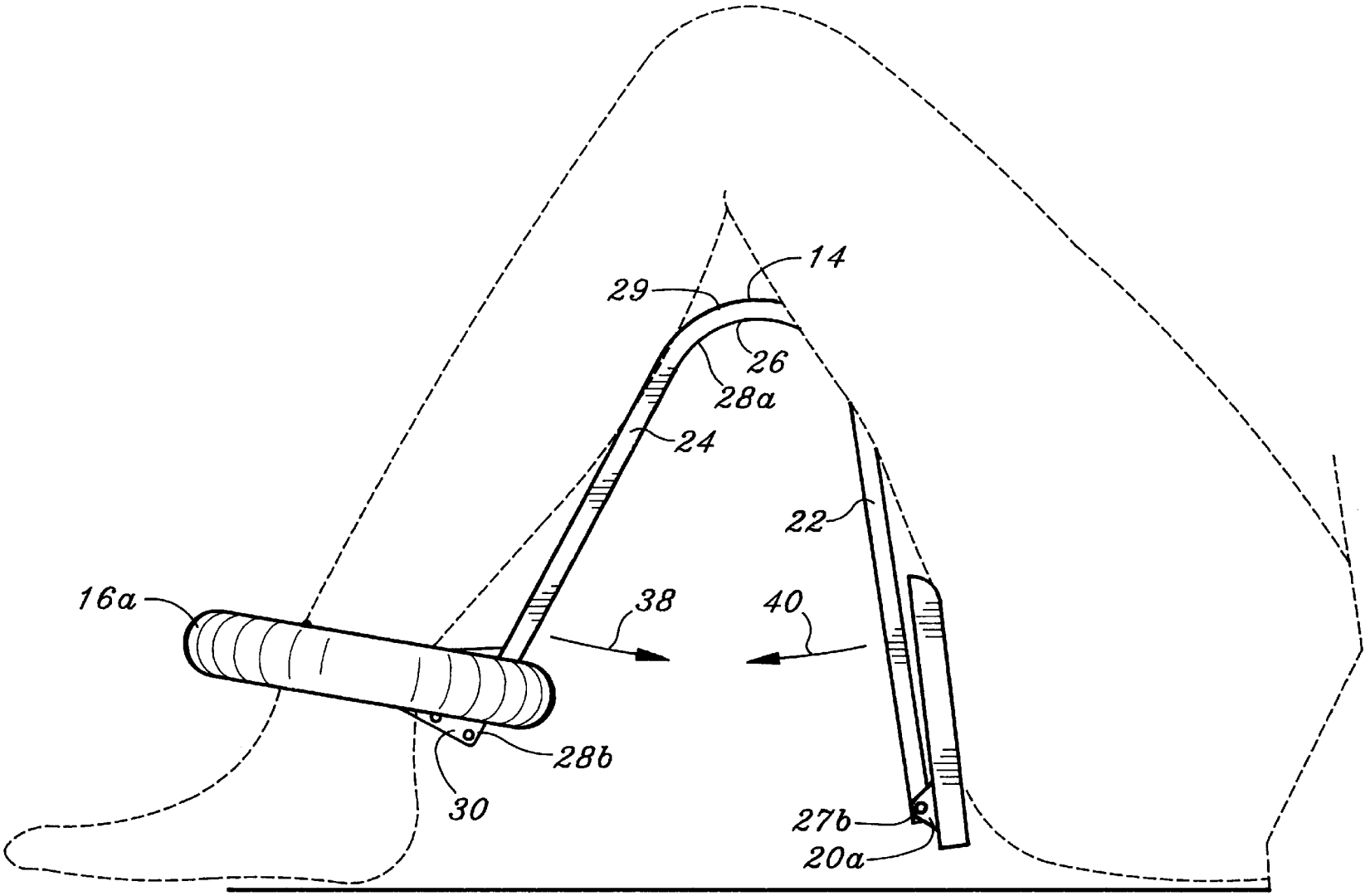
FIG. 1 illustrates the position of the muscle strengthening apparatus of the present invention with respect to a user, the user being shown in phantom.

When a user attempts to do "sit-up" exercises, typically the user's knees do not remain stationary and either move up or down as the user is attempting to do a "sit-up". Thus, the user's ankles move either upward and/or away from the user's buttock. Many times, the user attempts to compensate for this by exerting muscular force to hold his or her feet down to the floor. Many times, the user will have a second person hold the user's feet stationary while the user does the sit-up exercises. However, apparatus 200 of the present invention eliminates these problems. Referring to FIG. 1, when the user desires to use apparatus 200 of the present invention, the user places apparatus 200 on a flat surface, e.g. floor, and positions apparatus 200 such that (i) curved portion 222 of intermediate member 204 is positioned posteriorly and/or medially with respect to the user's knees, (ii) buttocks support member 202 is placed against the user's buttocks and (iii) the user's ankles are placed within openings 244 and 246 of members 236 and 238, respectively. In order to achieve optimum results, the user preferably maintains both feet in contact with the floor. The user may position his or her legs in a variety of ways in order to achieve optimum results. For example, it has been found that optimum results are achieved if the user positions his or her legs in a bend between about 60° and 120° with the femur and the tibia approximately 45° with respect to the floor. It also has been found that optimum results can be achieved if the user raises her or his legs such that the knees are bent about 90° and the femur is substantially perpendicular to the floor and the tibia is substantially parallel to the floor. Although the foregoing discussion describes specific angular positions of the user's legs, it is to be understood that the actual angular orientation of the user's legs may vary with each different user of apparatus 200.

When using apparatus 200 of the present invention as shown in FIG. 1, the user's ankles, knees and buttocks all remain substantially stationary. The natural tendency for the ankles to move away from the buttocks during an unassisted crunch or sit-up is counteracted by the resistance of resilient intermediate member 204. Members 236 and 238 and curved portion 222 of member 204 cooperate to substantially eliminate movement of the user's ankles and knees during use of apparatus 200. Any force of the user's ankles exerted in the direction indicated by arrow 280 is counteracted by a substantially equal force, indicated by arrow 282, created by the user's buttock against support member 202. These forces effect a resultant compressive force on sides 208 and 210 of intermediate member 204. Since intermediate member 204 is resilient, the aforementioned compressive force causes sides 208 and 210 to approach each other. It is highly preferable that the resistance of intermediate member 204 is of a degree that prevent sides 208 and 210 from contacting each other.

Muscle strengthening apparatus 200 of the present invention effects contraction of the hamstrings by squeezing the hamstrings, in effect, moving the ankles toward the buttocks simultaneously with contraction of the abdominal muscles. Apparatus 200 of the present invention effects strengthening of the abdominal muscles while simultaneously inhibiting contraction of the psoas. Specifically, as muscle strengthening apparatus 200 contracts the hamstrings, apparatus 200 inhibits the psoas thereby providing maximum efficiency in strengthening the abdominal muscles. Support member 202 facilitates an optimum pelvic posterior tilt thereby maximizing the efficiency in strengthening and toning the abdominal muscles and obliques. Support member 202 allows the user to roll to the side to perform exercises for the obliques. Use of apparatus 200 also strengthens and tones the hamstring muscles and Gluteus Maximum.

Muscle strengthening apparatus 200 of the present invention achieves proper rectus abdominal contraction and maximizes efficiency in strengthening the abdominal muscles and obliques. Apparatus 200 effects neuro inhibition to substantially eliminate use of the hip flexors. As the user does a sit-up, apparatus 200 causes contraction of the antagonistic muscles of the hip flexors which include the gluteus maximum and hamstrings. Apparatus 200 effects contraction of these muscles to substantially eliminate activity of the hip flexors thereby achieving isolated rectus abdominis contraction.

Thus, the apparatuses 10, 100 and 200 of the present invention:

a) stabilize the feet, knees and hips thereby maximizing the efficiency in toning and strengthening abdominal muscles and obliques;

b) effect toning and strengthening of other muscles, e.g. hamstrings and gluteus maximum, simultaneously with and in addition to the abdominal muscles;

c) facilitate correct pelvic tilt;

d) achieves significant increase in strength of abdominal muscles over a relatively short period of time;

e) prevent over development of the iliopsoas or hip flexors;

f) are lightweight and compact;

g) are inexpensive to manufacture;

h) are easy and convenient to use;

i) are transportable and easy to store; and j) provides a plurality of positions to which the feet securing member can be set thereby allowing users of different sizes or heights to use the apparatus of the present invention in a comfortable and efficient manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. The abdominal muscle conditioning apparatus comprising:

a resilient member comprising a first portion and a second portion, the first and second portions being angulated with respect to each other, the first and second portions each having an end opposite the point of contiguity of the first and second portions;

a feet securing member for securing the feet of a user, the feet securing member being attached to the end of the first portion; and a support member having a substantially planar surface for contacting the buttocks of the user, the support member having a bore therein that is sized for frictionally receiving a portion of the second portion of the resilient member, the portion of the second portion being frictionally and removably disposed within the bore;

whereby the apparatus effects contraction of the hamstring muscles when (i) the user's feet are secured by the feet securing member, (ii) the user's buttock contacts the support member, (iii) the user lies upon his or her back, (iv) the user performs sit-ups, and (v) the user moves his or her feet toward the user's gluteus maximus muscle during performance of the sit-ups, whereby the contraction of the hamstring muscles during performance of the sit-ups effects optimum abdominal muscle conditioning.

2. An abdominal muscle conditioning apparatus comprising:

a resilient member comprising a first portion and a second portion, the first and second portions being angulated with respect to each other, the first and second portions each having an end opposite the point of contiguity of the first and second portions;

a feet securing member for securing the feet of a user, the feet securing member being pivotally attached to the end of the first portion; and a support member having a substantially planar surface for contacting the buttocks of the user, the support member having a bore therein that is sized for frictionally receiving a portion of the second portion of the resilient member, the portion of the second portion being frictionally and removably disposed within the bore;

whereby the apparatus effects contraction of the hamstring muscles when (i) the user's feet are secured by the feet securing member, (ii) the user's buttock contacts the support member, (iii) the user lies upon his or her back, (iv) the user performs sit-ups, and (v) the user moves his or her feet toward the user's gluteus maximus muscle during performance of the sit-ups, whereby the contraction of the hamstring muscles during performance of the sit-ups effects optimum abdominal muscle conditioning.

3. A muscle conditioning apparatus comprising:

a resilient member comprising a first portion and a second portion, the first and second portions being angulated with respect to each other, the first and second portions each having an end opposite the point of contiguity of the first and second portions;

a pair of foot retaining members, each of which having a body portion defining an opening sized for receiving a foot of a user;

at least one axle member intermediate and attached to the foot retaining members, the axle member being pivotally attached to the end of the first portion of the resilient member; and a support member having a substantially planar surface for contacting the buttocks of the user, the support member having a bore therein that is sized for frictionally receiving a portion of the second portion of the resilient member, the portion of the second portion being frictionally and removably disposed within the bore.

* * * * *